US005091755A

United States Patent [19]

Tashiro

[11] Patent Number: 5,091,755

[45] Date of Patent: Feb. 25, 1992

[54] ORIGINAL DOCUMENT FEEDER FOR PRODUCING DOUBLE SIDED COPIES USING TWO EXPOSURE STATIONS

[75] Inventor: Osamu Tashiro, Osaka, Japan

[73] Assignee: Sharp Kabushiki Kaisha, Osaka, Japan

[21] Appl. No.: 390,766

[22] Filed: Aug. 8, 1989

[30] Foreign Application Priority Data

Aug. 10, 1988 [JP] Japan ..... 63-200787

[51] Int. Cl.[5] ..... G03G 21/00

[52] U.S. Cl. ..... 355/320; 271/3.1; 271/186; 355/233; 355/318

[58] Field of Search ..... 355/233, 235, 308, 318, 355/319, 320, 321; 271/3.0, 3.1, 4, 65, 186, 212, 225

[56] References Cited

U.S. PATENT DOCUMENTS 3,844,654 10/1974 Guenther ..... 355/24
4,140,387 2/1979 Gustafson ..... 355/319
4,261,661 4/1981 Thiers ..... 355/319 X
4,384,782 5/1983 Acquaviva ..... 271/3.1 X
4,536,077 8/1985 Stoffel ..... 355/235
4,586,812 5/1986 Kaneko et al. ..... 355/319 X
4,980,729 12/1990 Okamoto ..... 355/320

*Primary Examiner*—A. T. Grimley
*Assistant Examiner*—Christopher Horgar
*Attorney, Agent, or Firm*—Birch, Stewart, Kolasch & Birch

[57] ABSTRACT

An original document feeder which is so arranged that directions indicated by front and reverse surfaces of the original documents stacked in an original document accommodating section remain the same as the directions of front and reverse surfaces of the original documents initially accommodated in the accommodating section at all times during the copying operation, while constructions around the original document accommodating section can be simplified for efficient operation.

3 Claims, 8 Drawing Sheets

ORIGINAL DOCUMENT FEEDER FOR PRODUCING DOUBLE SIDED COPIES USING TWO EXPOSURE STATIONS

BACKGROUND OF THE INVENTION

The present invention generally relates to an original document feeding arrangement and more particularly, to an original document feeder provided, for example, in an electrostatic copying apparatus and the like for successively supplying original documents in sheet-form to a reading region.

Conventionally, in an optical reading apparatus arranged to read the surface of an original document through a slit exposure, for example, as in a transfer type electrostatic copying apparatus or the like, there is provided a first type exposing means arranged to effect exposure for reading by moving the optical system, with the original document fixed, or a second type exposing means adapted to effect exposure for reading by displacing the original document, with the optical system held stationary. In the second type exposing means as referred to above, there are cases where a recirculating document handler (referred to as RDH hereinafter) is employed for effecting an automatic transport of an original document in such a manner as to successively feed sheet-formed original documents to a reading region one sheet by one sheet, and to return the original document back to the original position after exposure and reading thereof.

FIG. 5 is a schematic side sectional view of one example for a conventional recirculating document handler RDH1, which generally includes an original document accommodating section 3 for accommodating therein a stack of original documents 2 in a sheet-form to be copied, a support cylinder 5 of a right circular cross section for supporting the original document 2 thereon so as to be passed through a reading region 4, and an original document transport path 8 constituted by a transport passage 6 for transporting the original document from accommodating section 3 to the reading region 4 and another transport passage 7 for returning the original document from the reading region 4 back to the accommodating section 3.

The original documents 2 stacked in the accommodating section 3 for copying are positively fed by sheet feeding roller 9, one sheet by one sheet, from the uppermost portion of the stack into the transport passage 6. The original document transported through the passage 6 is supported by the support cylinder 5 and passed above a transparent plate 10 made of a hard glass material or the like provided at the reading region 4. Onto the surface of the original document 2 passing above the transparent plate 10, light from an exposure lamp of an optical system (not shown) is projected so as to read the image of the original document 2 for effecting copying operation within a housing of a copying apparatus (not shown here). The original document 2 thus read for its one surface is transported through the passage 7, and is accommodated at the lowermost portion of the stack of the original documents 2 stored in the accommodating section 3.

Each time the original document 2 is fed from the accommodating section 3, and returned to the lowermost portion of the section 3 again through the reading region 4, the original document thus returned is accommodated in the accommodating section 3 in the state where it is inverted from its front surface as it is fed, to the reverse surface thereof. More specifically, the one surface of the original document 2 directed upwards in FIG. 5 as said original document 2 is fed from the accommodating section 3, is inverted to be directed downwards when the original document 2 is again accommodated in the accommodating section 3 via the reading region 4.

In the case where a duplex or both side copying is to be effected through employment of the document handler RDH 1 for copying a duplex original document having information to be copied on its opposite surfaces, onto respective surfaces of a copy paper sheet corresponding to the original document, the directions indicated by the front and reverse surfaces of the original document 2 which has been read for its one surface and returned to be stacked in the accommodating section 3, are inverted as compared with those indicated by the front and reverse surfaces of said original document stored in said section 3 before the start of the copying operation. Accordingly, by way of example, in the case where, after the original document 2 is again fed from the accommodating section 3 so as to be read successively for its other surface not yet read, this original document 2 is subjected to jamming in the transport passage 6, and there is a possibility that, when the original document thus subjected to the jamming is to be returned to the accommodating section 3, the original document is again stacked, without it being noticed that the directions of the front and reverse surfaces thereof have been inverted with respect to those of said original document initially accommodated in the accommodating section 3, thus resulting in the copying of the wrong surfaces.

Moreover, in the arrangement of the known document handler RDH 1 as described so far, the original document 2 is fed from the right side at the uppermost portion of the original documents stacked in the original document accommodating section 3 in FIG. 5 at all times, and after the reading function, said original document is returned to the section 3 from the right side at the lowermost portion of the stack of the original documents. Accordingly, since the original document feeding structure to the transport passage 6 and the original document accommodating structure from the transport passage 7 are provided to be deviated towards one side (i.e. towards the right side in FIG. 5) of the original document accommodating section 3, the construction at one side of the accommodating section 3 is undesirably complicated.

SUMMARY OF THE INVENTION

Accordingly, an essential object of the present invention is to provide an original document feeder which is so arranged that directions indicated by front and reverse surfaces of the original documents stacked in an original document accommodating section remain the same as the directions of front and reverse surfaces of the original documents initially accommodated in said accommodating section at all times during the copying operation, while constructions around the original document accommodating section can be simplified for efficient operation.

Another object of the present invention is to provide an original document feeder of the above described type which is stable in functioning at high reliability, and can be readily incorporated into copying apparatuses and the like at low cost.

In accomplishing these and other objects, according to one preferred embodiment of the present invention, there is provided an original document feeder which includes an original document accommodating section arranged to feed the original document from one end side at the uppermost portion of a stack of sheet-formed original documents and to return said original document from the other end side at the lowermost portion of said stack, a first original document presenting section for supporting the original document to read one surface of said original document to be fed from said original document accommodating section, a second original document presenting section for supporting the original document to read the other surface of said original document, a first original document inverting means provided between said first original document presenting section and said second original document presenting section for inverting front and reverse surfaces of said original document, and a second original document inverting means for reversing transporting direction of the original document without inverting the front and reverse surfaces of said original document after supporting by said second original document presenting section.

By the arrangement of the original document feeder for feeding the original document in the sheet-form to read the information on the surface thereof according to the present invention, the original documents are first accommodated in the original document accommodating section in a stack so as to be fed from one end side at the uppermost portion of the stack one sheet by one sheet. The original document thus fed from the original document accommodating section is supported on the first original document presenting section so as to be read for its one surface. The original document thus read for its one surface at said first original document presenting section is inverted in the front and reverse surfaces thereof at the first original document inverting means and transported to the second original document presenting section, on which said original document is supported so as to be read for its other surface. The original document completed for reading is transported to the second original document inverting means, where it is reversed in its transport direction, without inverting the front and reverse surfaces thereof, and is returned to the lowermost portion of the stack of the original documents stored in the accommodating section from the other end portion thereof.

Therefore, the directions of the front and reverse surfaces of the original documents accommodated within the original document accommodating section remain the same at all times, while, at the portions around the original document accommodating section, since the constructions for feeding and returning the original documents are arranged to confront each other, with the original document accommodating section held therebetween, such portions are free from complication.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
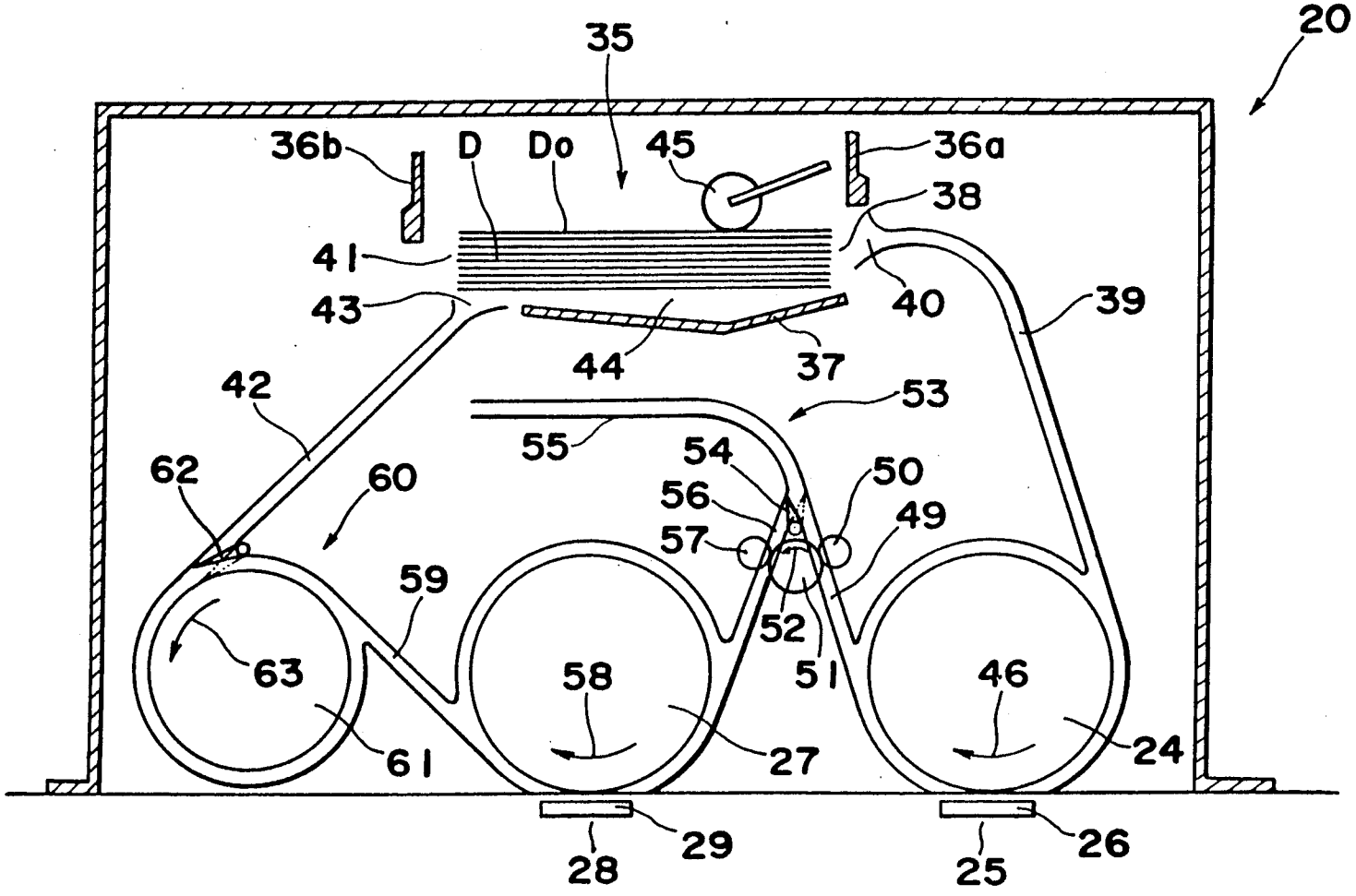
FIG. 1 is a schematic side sectional view of an original document feeder according to one preferred embodiment of the present invention.

Before the description of the present invention proceeds, it is to be noted that like parts are designated by like reference numerals throughout the accompanying drawings.

Figure 2:
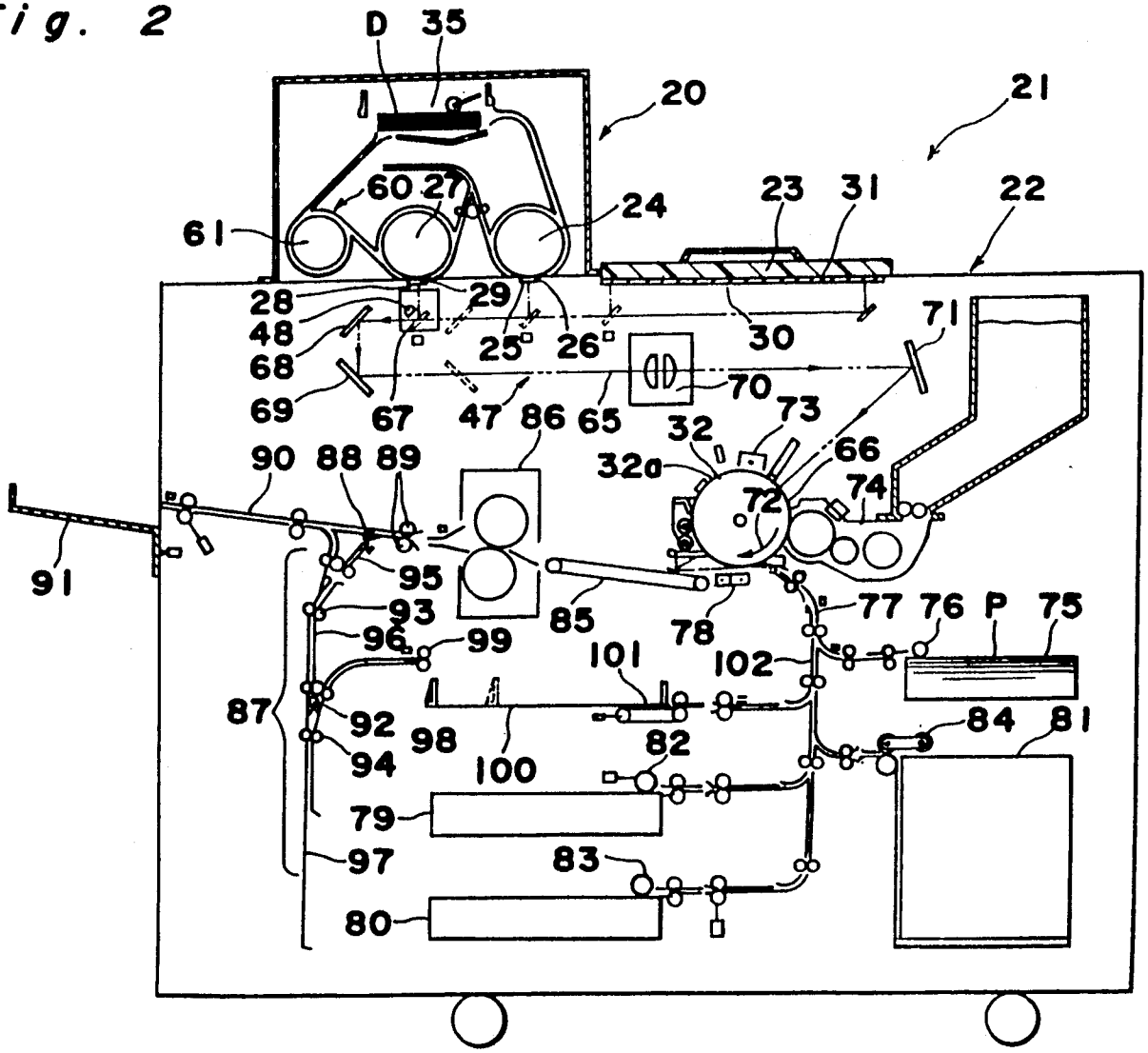
FIG. 2 is a schematic side sectional view of a transfer type electrostatic copying apparatus to which the original document feeder of FIG. 1 may be applied, FIGS. 3(*a*) to 3(*h*) are schematic diagrams showing essential portions of the copying apparatus and the original document feeder of FIG. 2 on an enlarged scale for explaining functions of a duplex copying of a both-sided original document.
Figure 3A:
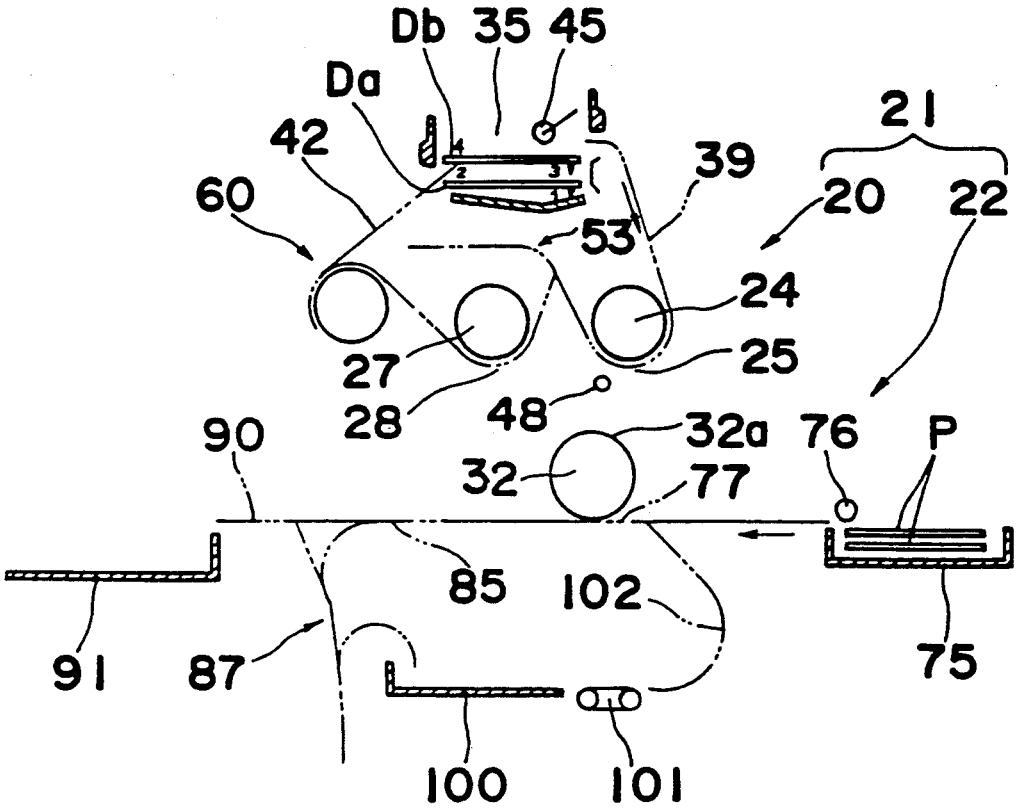
Figure 3B:
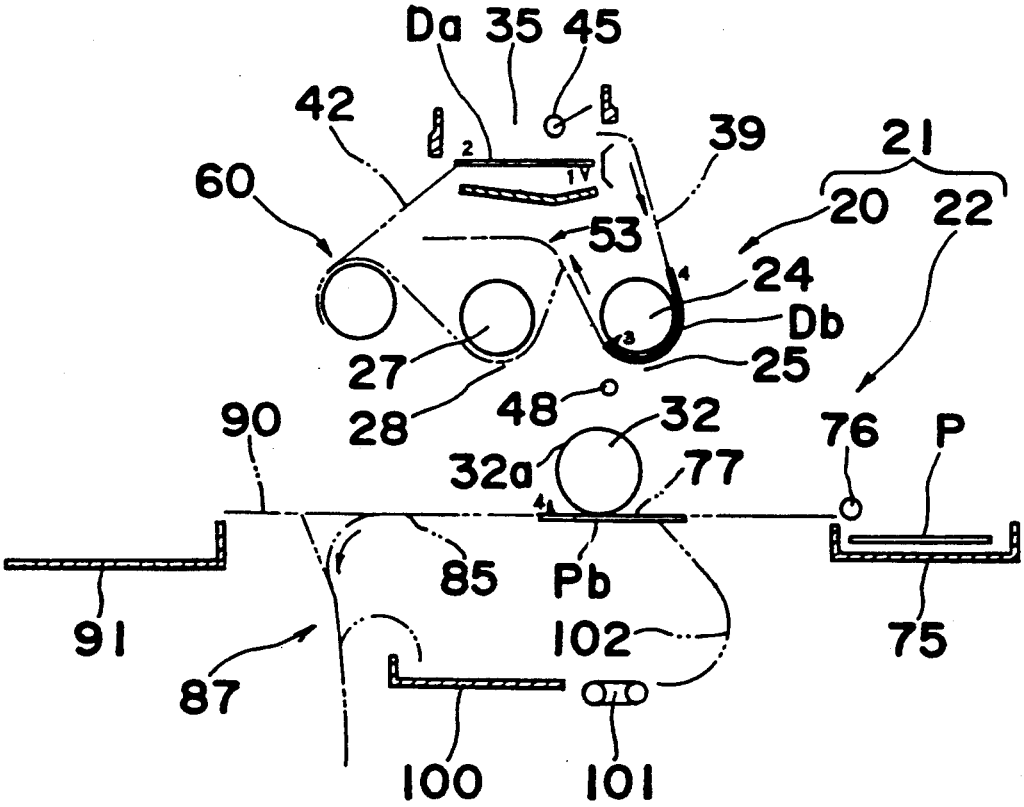
Figure 3C:
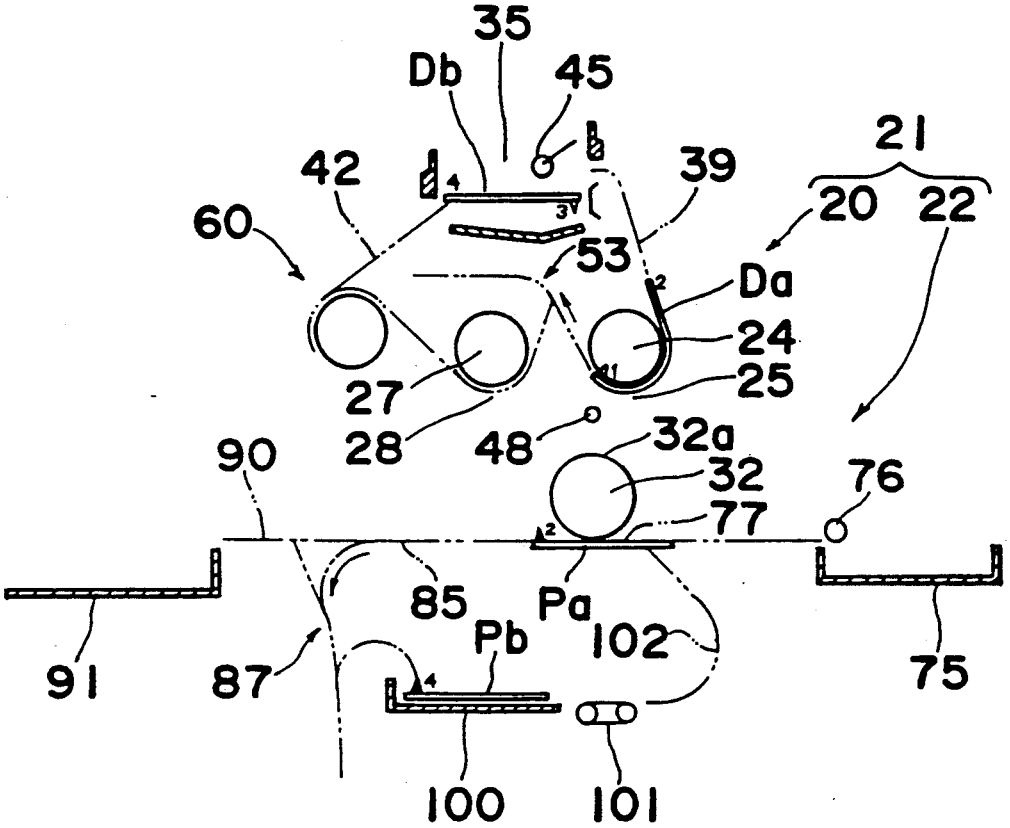
Figure 3D:
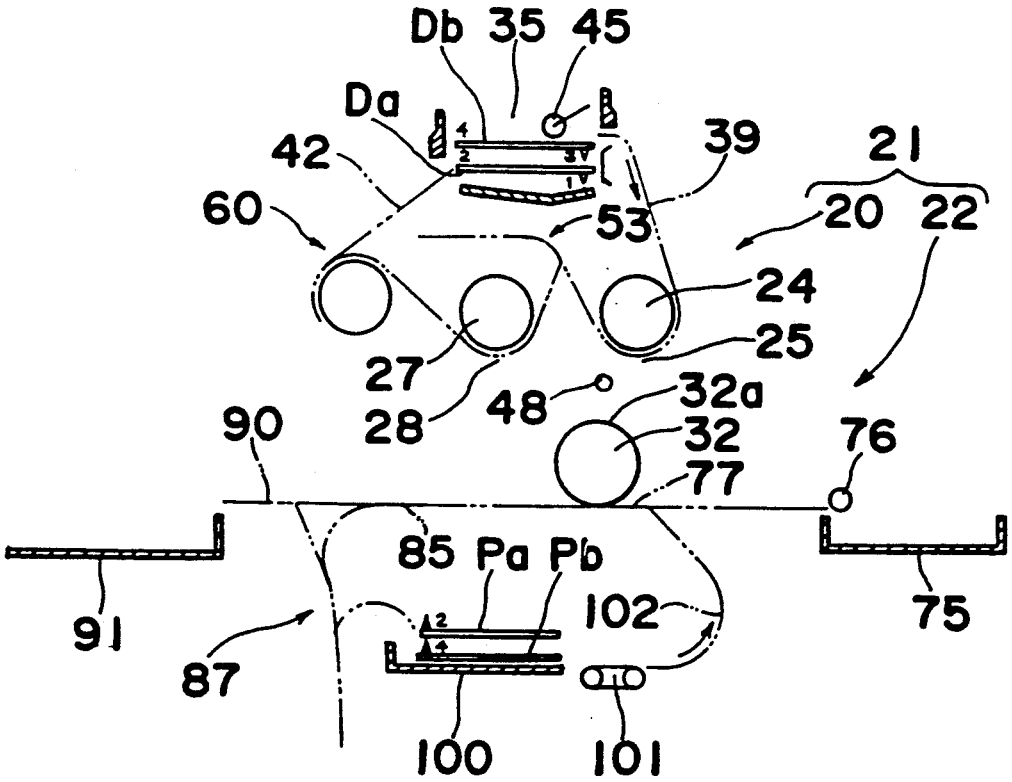
Figure 3E:
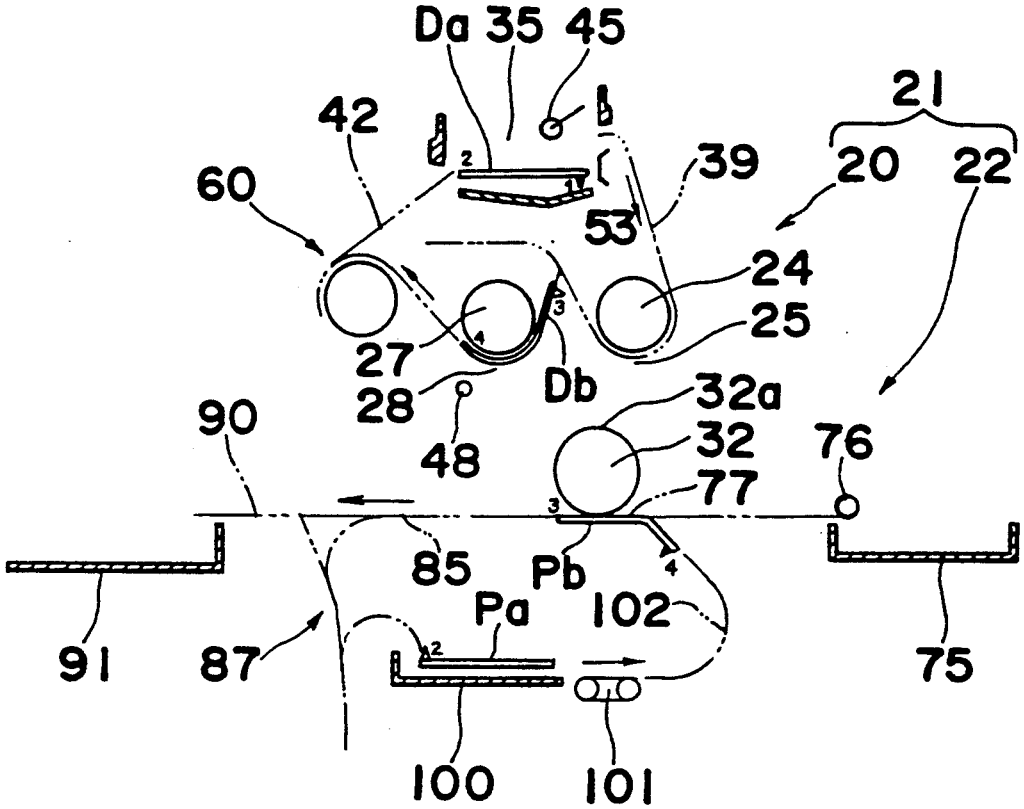
Figure 3F:
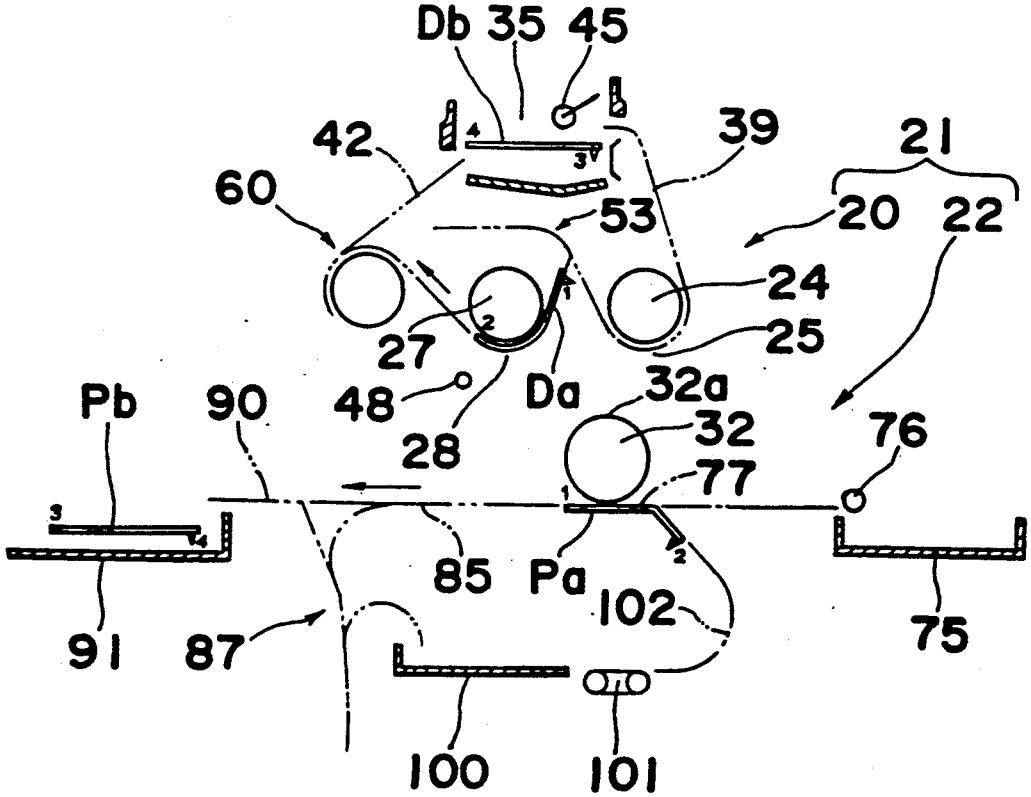
Figure 3G:
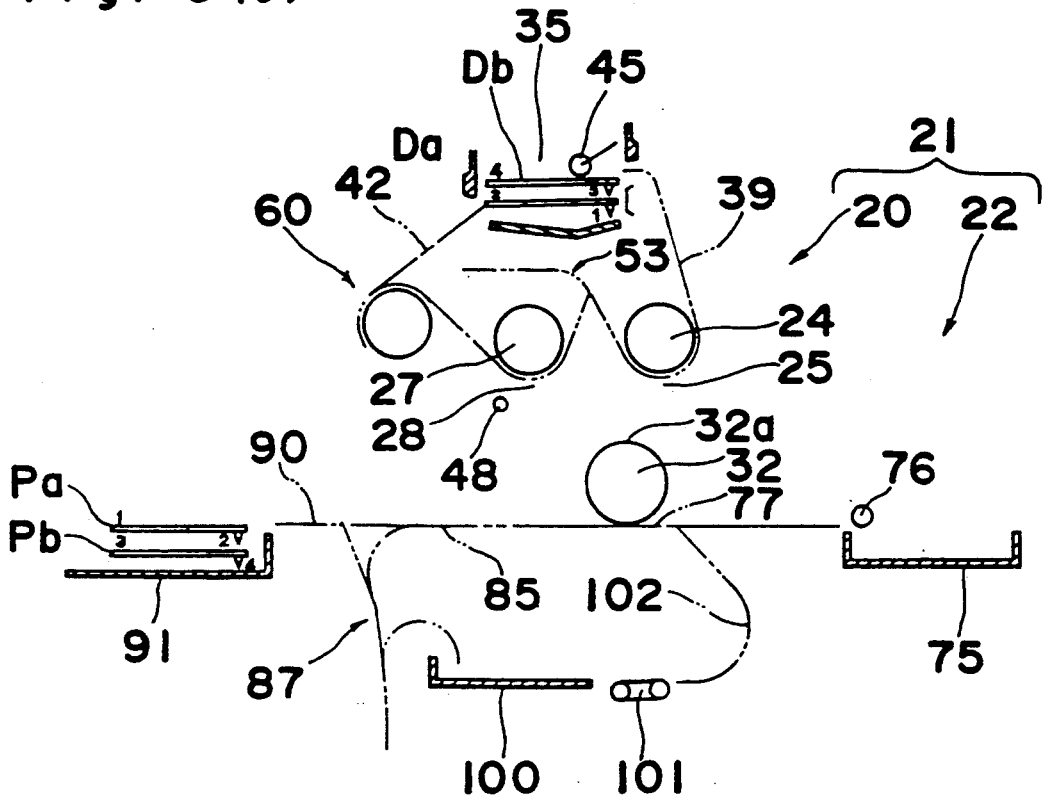
Figure 3H:
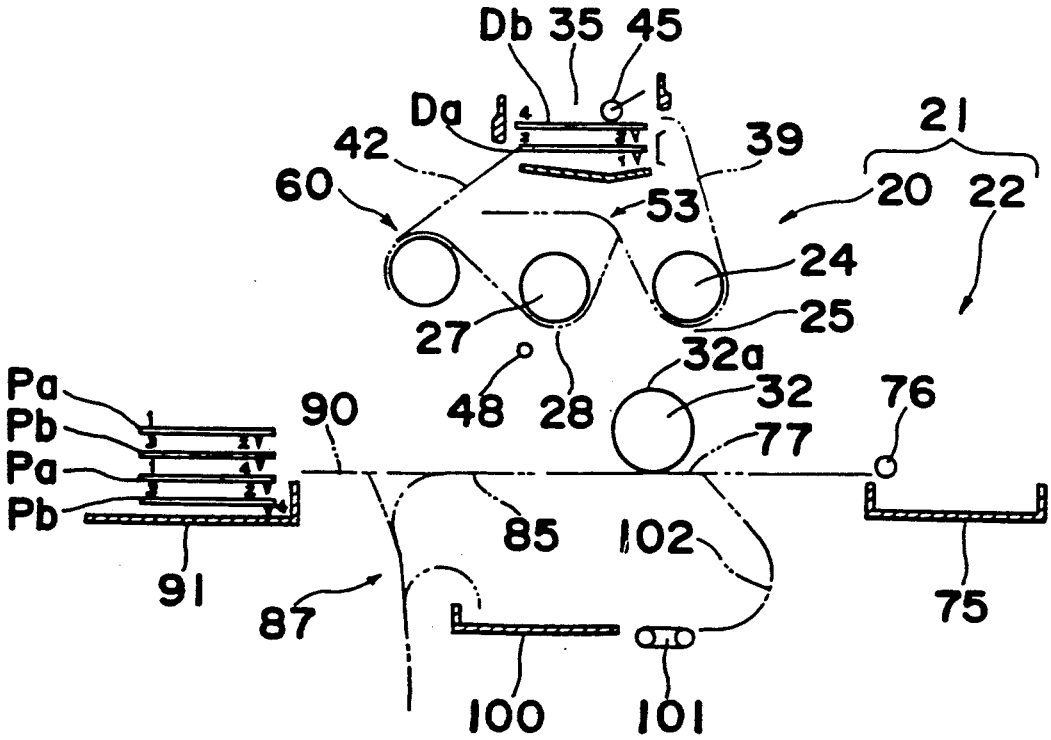

Referring now to the drawings, there are shown in FIG. 1 an original document feeder i.e. recirculating document handler 20 according to one preferred embodiment of the present invention, and in FIG. 2, a transfer type electrostatic copying apparatus 21 to which the original document feeder 20 of FIG. 1 may be applied.

In FIG. 1, the original document feeder 20 generally includes an original document accommodating section 35 arranged to feed the original document from one end side at the uppermost portion of a stack of sheet-formed original documents and to return said original document from the other end side at the lowermost portion of said stack, a first support cylinder 24 having a circular cross section for supporting the original document to read one surface of said original document to be fed from said original document accommodating section 35, a second support cylinder 27 also having a generally right circular cross section for supporting the original document to read the other surface of said original document, a first original document inverting means 53 provided between the first support cylinder 24 and second support cylinder 27 for inverting front and reverse surfaces of the original document, and a second original document inverting means 60 for reversing transporting direction of the original document without inverting the front and reverse surfaces of the original document after supporting by the second support cylinder.

At the upper portion of a housing 22 (FIG. 2) of the transfer type electrostatic copying apparatus 21, there are disposed the original document feeder 20 for reading original documents in sheet-form, and a presser plate 23 for covering thick original documents such as books or the like to be copied.

Furthermore, at the upper portion of the apparatus housing 22 below the original document feeder 20, in a position corresponding to the lower portion of the first support cylinder 24 within the feeder 20, a first transparent plate 26 for the first reading region 25 is provided, while in another position confronting the lower portion of the second support cylinder 27, a second transparent plate 29 for a second reading region 28 is provided. Moreover, at the upper portion of the apparatus housing 22 adjacent to the feeder 20, a third transparent plate 31 for a third reading region 30 to read a thick original document is provided in a position confronting the presser plate 23 as shown in FIG. 2.

For copying original documents D in sheet-form, such original documents D are accommodated in a stack at the original document accommodating section 35 provided within the original document feeder 20. The original document accommodating section 35 is generally constituted by side walls 36*a* and 36*b*, and a bottom plate 37. The side wall 36*a* is formed with an opening 38, adjacent to which, there is disposed a transport starting port 40 of a transport passage 39 through which the original document D is transported after being fed. Meanwhile, in the vicinity of a junction between the side wall 36*b* and the bottom plate 37, another opening 41 is formed, near which, there is provided a transport completion port 43 of a transport passage 42 through which the read original document D is transported to be returned to the original document accommodating section 35.

The bottom plate 37 is formed with a recess 44 that gently slopes down generally towards its central portion, and when a sheet feeding roller 45 for feeding the original documents D contacts the uppermost sheet Do of the original documents D in the stack, the roller 45 depresses the original documents D in the direction of the recess 44, thus causing the stack of the original documents D to be deflected. By such deflection, gaps may be formed between the respective original documents D, and by rotating the paper feeding roller 45 in the above state in which gaps are formed between the original documents D, the original document Do at the uppermost layer on the stack of the original documents may be readily fed. Even when the uppermost original document Do should be led towards the transport starting port 40 of the transport passage 39 together with a plurality of sheets of other original documents D, such original documents are positively separated one sheet by one sheet by a separating roller or the like (not shown) so as to be fed into the transport passage 39 in a single sheet.

The original document D fed through the transport passage 39 is transported to the first support cylinder 24. On the outer peripheral surface of the first support cylinder 24, for example, suction ports(not shown) are formed, which are connected to a suction means within the support cylinder 24. Therefore, by driving this suction means, the original document D fed to the first support cylinder 24 is closely attracted over the outer peripheral surface of said cylinder 24 so as to be supported thereon. The first support cylinder 24 is driven for rotation in the direction indicated by an arrow 46, and thus, the original document D supported on the first support cylinder 24 passes above the first transparent plate 26 at the first reading region 25. When the original document D passes over the first transparent plate 26, light of an exposure lamp 48 of an optical system 47(FIG. 2) provided in the vicinity of the first reading region 25 is projected onto one surface of the original document D passing therethrough, and thus, information on said one surface of the original document D is read, through the optical system 47, onto a photosensitive surface 32*a* of a photoreceptor drum 32 for exposure which is rotatably provided generally at an upper central portion of the apparatus housing 22.

The original document D thus read for its one surface is transported to the transport passage 49, where a set of transport rollers 50 and 51 are provided, and by driving the roller 51 for rotation in a direction indicated by an arrow 52, the other roller 50 held in contact with said roller 51 is rotated in a direction opposite to that of the arrow 52. By these rollers 50 and 51, the original document D fed to the transport passage 49 is transported to the first original document inverting means 53.

The first original document inverting means 53 is provided with a direction change-over claw 54 and transport rollers (not shown) capable of rotating in forward and reverse directions. While the original document is transported from the transport passage 49 to the transport passage 55 of the first original document inverting means 53, the direction change-over claw 54 is set at a position indicated by a solid line in FIG. 1. When a transport direction upstream end of the original document D to be transported to the transport passage 55 of the first original document inverting means 53, passes through the direction change-over claw 54, said original document D is started to be fed in a returning direction from the transport passage 55 to the transport passage 49 by the transport rollers (not shown). Simultaneously, since the direction change-over claw 54 is changed over from the position indicated by the solid line to a position shown by an imaginary line, the original document D is transported from the transport passage 55 to a transport passage 56. By passing through the original document inverting means 53, the surface of the original document D to be read and exposed at the second reading region 28 is to be the other surface of said original document D which has not been read as yet at the first reading region 25 already passed through.

In the transport passage 56, since a transport roller 57 is provided to be in a set with the transport roller 51 referred to earlier and rotating in the direction of the arrow 52, said transport roller 57 held in contact with the roller 51 is rotated in a direction opposite to that of the arrow 52, and the original document D transported into the passage 56 by the set of transport rollers 51 and 57, is further fed onto the second support cylinder 27.

The second support cylinder 27 has the construction similar to that of the first support cylinder 24 and is driven for rotation in a direction indicated by an arrow 58. The original document D thus fed is closely attracted over the second support cylinder 27, and is passed above the second transparent plate 29 at the second reading region 28 as said cylinder 27 rotates. At the second reading region 28, light of the exposure lamp 48 is projected onto the other surface of the original document D passing above the second transparent plate 29 and the information thereon is read for exposure onto the photosensitive surface 32*a* of the photoreceptor drum 32 through the optical system 47. The original document D thus read for its other surface is transported into a transport passage 59.

At the downstream side in the transport direction of the transport passage 59, the second original document inverting means 60 which includes a third support cylinder 61 of a circular cross section and a direction change-over claw 62 is provided. This third support cylinder 61 has the construction similar to that of the first support cylinder 24 or the second support cylinder 27 described earlier, and can further be driven for rotation in the forward and reverse directions. The original document D transported into the second original document inverting means 60 through the transport passage 59 is transported as it is closely attracted over the third support cylinder 61 driven for rotation in a direction indicated by an arrow 63, during which time, the direction change-over claw 62 is set at the position indicated by a solid line in FIG. 1. When the upstream edge in the transport direction of this original document D which is being transported, passes through the direction change-over claw 62, the third support cylinder 61 is started to be driven for rotation in a direction opposite to that indicated by the arrow 63. Upon rotation of the third support cylinder 61 in the opposite direction, the claw 62 is changed over from the position indicated by the solid line in FIG. 1 to a position shown by an imaginary line, and therefore, the original document D closely contacting the third support cylinder 61 is separated therefrom by the forward edge of said claw 62 so as to be fed into a transport passage 42. Accordingly, by passing through the second original document inverting means 60, only the transport direction of the original document D is inverted, without inverting the directions indicated by the front and reverse surfaces of the original document D.

The original document D fed into the transport passage 42 is led into the original document accommodating section 35, and is returned to the lowermost portion of the stack of original documents stored in the accommodating section 35 through the transport completion port 43 of the passage 42. When the original document D is transported in the above described manner, the front and reverse surfaces of the original document D are directed in the same directions at all times, both before the feeding of the original document D from the accommodating section 35 and during accommodation thereof back into the accommodating section 35 again as it is returned thereto subsequent to the reading after the feeding.

Accordingly, even when an original document D should cause jamming in the course of transportation, said original document D thus subjected to the jamming may be again placed on the uppermost portion of the stack of the original documents in the accommodating section 35, with the front and reverse surfaces thereof being directed in the same directions as they are directed when said original document D was originally placed thereon, and thus, operability of the feeder 20 can be improved. Moreover, in the vicinity of the original document accommodating section 35, since the construction for feeding the original document D from the accommodating section 35 and the construction for returning the original document D to said accommodating section are provided to respectively confront the accommodating section 35, without deviating to one side of said section 35, there is not such a problem that only one side of the accommodating section 35 is complicated, and thus, surrounding portions of said accommodating section 35 can be simplified.

As described above, at the first and second reading regions 25 and 28 or the third reading region 30 for the thick original documents, upon projection of light from the exposure lamp 48 of the optical system 47 onto the surface of the original document to be read, the light reflected from the surface of the original document forms an image at an exposure region 66 on the photosensitive surface 32*a* of the photoreceptor drum 32 through a light path 65 by the optical system 47 which includes the exposure lamp 48, reflecting mirrors 67, 68, and 69, a zoom lens assembly 70 and another reflecting mirror 71.

The photosensitive surface 32*a* of the photoreceptor drum 32 driven for rotation in the direction indicated by an arrow 72 is first charged by a main corona charger 73. Subsequently, as described above, by the optical system 48, the image corresponding to that on the surface of the original document read at each reading region 25, 28 or 30 is formed at the exposure region 66, and thus, the electrostatic latent image corresponding to the surface of the original document is formed thereat. The electrostatic latent image thus formed is formed into a visible toner image by a developing device 74 disposed around the photoreceptor drum 32 in a position subsequent to the corona charger 73. The toner image thus formed is transferred onto a copy paper sheet P fed from a paper feeding cassette 75 by a paper feeding roller 76 and transported through a transport passage 77, to pass by a transfer corona charger 78 also disposed below said photoreceptor drum 32.

In FIG. 2, the copying apparatus 21 is further provided with paper feeding cassettes 79, 80 and 81, etc. besides the cassette 75 referred to above. In the respective paper feeding cassettes 79, 80 and 81, copy paper sheets of different sizes are accommodated so as to be fed into the transport passage 77 by respective rollers 82, 83 and 84 according to the purpose for end use for subsequently being subjected to the copying operation.

After transfer, the copy paper sheet P is transported into a fixing device 86 by a transport means 85 for being fixed with the transferred image thereon. For effecting one side copying in which copying is made onto only one surface of the copy paper sheet P, since a first direction change-over claw 88 as part of a copy paper inverting means 87 is set at a position indicated by a solid line in FIG. 2, the fixed copy paper sheet P is transported into a transport passage 90 by a set of transport rollers 89 so as to be discharged onto a discharge tray 91 thereafter. On the other hand, when the duplex copying for copying on both surfaces of the copy paper sheet P is to be effected, the copy paper sheet completed for copying function on one surface thereof is further transported to a copy paper sheet inverting means 87 instead of being discharged onto the discharge tray 91 so as to effect copying on its other surface not subjected to copying as yet.

The copy paper sheet inverting means 87 includes the first direction change-over claw 88, a second direction change-over claw 92, a set of transport rollers 93, and another set of transport rollers 94 capable of being rotated in the forward and reverse directions. Since the first direction change-over claw 88 is set at the position indicated by an imaginary line in FIG. 2, the copy paper sheet P completed for copying on its one surface is transported into the transport passage 95.

The copy paper sheet P transported into the passage 95 is fed into a transport passage 96 by the transport rollers 93, and is further transported towards the transport passage 97, since the second direction change-over claw 92 is set at the position indicated by the imaginary line in FIG. 2. When the upstream end in the transport direction of the copy paper sheet P transported to the transport passage 97, passes through the second direction change-over claw 92, the transport roller 94 is driven for rotation in the direction to return the copy paper sheet P towards the passage 96. Since the second direction changeover claw 92 is changed over to the position shown by the solid line in FIG. 2, simultaneously with the driving of the transport rollers 94 in the above described direction for rotation, the copy paper sheet P is fed from the transport passage 97 to the transport passage 98 so as to be subsequently discharged onto an intermediate tray 100 by a set of discharge rollers 99.

The copy paper sheet P thus accommodated onto the intermediate tray 100 is again fed by a transport belt 101 towards the photoreceptor drum 32 through transport passages 102 and 77 for copying function on the other surface thereof not subjected to copying as yet. The copy paper sheet P completed for the duplex copying function in the earlier described manner is transported into the transport passage 90 by the transport rollers 89 since the first direction change-over claw 88 of the copy paper sheet inverting means 87 is changed over to the position indicated by the solid line in FIG. 2, and is then discharged onto the discharge tray 91.

Reference is also made to schematic diagrams showing essential portions of the transfer type electrostatic copying apparatus 21 and the original document feeder 20 for explaining functions of the duplex copying for both sided original documents Da and Db. In the subsequent description, when the surfaces of the original document D are to be represented, a subscript "a" shows a first original document and a subscript "b" indicates a second original document. Meanwhile, subscripts in numerals 1 to 4 represent page numbers of a set of piled up original documents D. For example, the first page of a first original document D is denoted as Dal. Similarly, the subscripts a and b, and 1 to 4 are affixed to show the surfaces of copy paper sheets P. In the reference symbols for the original documents D and the copy paper sheets P, those affixed with the same subscripts are in such relation that the surface of the original document D to be read is equivalent to the surface of the copy paper sheet P as copied.

For convenience, in FIGS. 3(*a*) to 3(*h*), numerals representing respective pages are entered on the surfaces of the respective original documents D, and particularly, on the surfaces of the odd-numbered pages, symbols of white triangles are entered. Meanwhile, for the respective copy paper sheets P, numerals showing the surfaces of the read original documents are entered on their surfaces completed for copying, and in particular, on the surfaces of odd-numbered pages, symbols of black triangles are entered. On the other hand, when the original documents D and copy paper sheets P are described on the whole, the subscripts are abbreviated for brevity.

For the duplex copying of the two original documents Da and Db, as shown in FIG. 3(*a*), the original documents Da and Db are stacked on the original document accommodating section 35 in the original document feeder 20 so that the page numbers thereof are successively increased from the lower portion to the upper portion. Meanwhile, the copy paper sheets P are accommodated in a stack on the cassette 75 within the housing of the copying apparatus 21.

Upon starting the functions for the duplex copying, as shown in FIG. 3(*b*), the second original document Db located at the uppermost portion of the stack of the original documents D on the section 35 is transported into the transport passage 39 by the transport roller 45. The second original documents Db thus fed into the passage 39 is supported by the first support cylinder 24 and passes through the first reading region 25, where light of the exposure lamp 48 is projected onto the fourth page Db4 which is one surface of the second original document Db. The light reflected from the surface of the second original document fourth page Db4 forms an image on the photosensitive surface 32*a* of the photoreceptor 32, and thus, an electrostatic latent image corresponding to the information on said original document fourth page Db4 is formed thereon. The toner image obtained by visualizing said electrostatic latent image is transferred onto one surface of the second copy paper sheet Pb transported into the transport passage 77 from the cassette 75 through the feeding roller 76

The second original document Db read for its fourth page Db4 at the first reading region 25 is supported by the second support cylinder 27 after passing through the first original document inverting means 53, and passes through the second reading region 28, at which region, no reading function is effected, and the second original document Db is reversed in its transport direction through the second original document inverting means, and is returned to the lower portion of the first original document Da accommodated in the accommodating section 35 through the transport passage 42.

The second copy paper sheet Pb copied, on its one surface, with the fourth page Db4 read when the second original document Db passed through the first reading region 25, is accommodated onto the intermediate tray 100 through the copy paper sheet inverting means 87 after passing through the transport means 85.

After the second original document Db has been accommodated in the original document accommodating section 35, the first original document Da is fed by the paper feeding roller 45 so as to be fed into the transport passage 39 as shown in FIG. 3(*c*). The first original document Da thus transported into the transport passage 39 is supported by the first support cylinder 24 and passes through the first reading region 25, at which region, light from the exposure lamp 48 is projected onto the surface of the second page Da2 which is one surface of the first original document Da. The light reflected by the surface of the first original document second page Da2 forms the image on the photosensitive surface 32*a* of the photoreceptor drum thereby forming an electrostatic latent image corresponding to said first original document, second page Da2. The toner image obtained by visualizing this latent image is transferred onto one surface of the first copy paper sheet Pa fed from the cassette 75 by the feeding roller 76 and transported into the transport passage 77.

The first original document Da read for its second page Da2 at the first reading region 25 passs through the second reading region 28 without being read after passing through the first original document inverting means 53 in the similar manner as in the second original document Db, and thereafter, through the second original documnet inverting means 60 and the transport passage 42, returned for accommodation, to the lower portion of the second original document Db stored in the accommodating section 35 as shown in FIG. 3(*d*).

The two original documents Da and Db again accommodated in the original document accommodating section 35 after the reading function as described above, are stacked in the similar manner as in the initial accommodation so that the page numbers are successively increased from the lower portion to the upper portion.

The copy paper sheet Pa copied, on its one surface, with the first original document second page Da2 read at the first reading region 25, is piled up on the upper portion of the copy paper sheets Pb stored on the intermediate tray 100 through the copy paper inverting means 87, after passing through the transport means 85. The copy paper sheets Pa and Pb accommodated on the intermediate tray 100 are stacked up in the order of the second copy paper sheet Pb and the first copy paper sheet Pa from the lower portion to the upper portion, and in such a manner that the surfaces completed for copying of the respective copy paper sheets Pa and Pb are directed upwards in FIG. 3(*d*).

When the first original document Da has been returned to the accommodating section 35 for accommodation, the second original document Db is again fed by the roller 45 so as to be transported into the passage 39. The second original document Db transported into the transport passage 39 is supported by the first support cylinder 24, and is transported to the first original document inverting means 53 without being read at the first reading region 25. The second original document Db which has passed through the first original document inverting means 53 is supported by the second support cylinder 27 and passes through the second reading region 28. At said second reading region 28, the light of the exposure lamp 48 which has been displaced from the first reading region 25 to the second reading region 28 is projected onto the surface of the third page Db3 which is the other surface of the second original document Db not read as yet. The light reflected by the surface of the second original document third page Db3 forms an image on the photosensitive surface 32*a* of the photoreceptor drum 32, thereby forming an electrostatic latent image corresponding to the information on the surface of the second original document third page Db3.

The copy paper sheet Pb located at the lowermost portion of the copy paper sheets P each completed for copying at one surface and stacked up on the intermediate tray 100 is fed by the transport belt 101, and is transported onto the photoreceptor drum 32 through the transport passages 102 and 77. The toner image obtained by visualizing the electrostatic latent image formed on the photosensitive surface 32*a* of the photoreceptor drum 32 is transferred onto the other surface of the second copy paper sheet Pb not subjected to copying as yet.

The second original document Db read for its third page Db3 at the second reading region 28 is transported into the tranport passage 42 through the second original document inverting means 60 so as to be returned to the lower portion of the first original document Da accommodated on the accommodating section 35. Meanwhile, the second copy paper sheet Pb completed for copying on both surfaces is discharged onto the discharge tray 91 via the transport passage 90 after passing through the transport means 85.

When the second original document Db is returned for accommodation on the original document accommodating section 35, the first original document Da is again fed by the roller 45 so as to be transported to the transport passage 39. The first original document Da transported into the transport passage 39 passes through the first reading region 25 without being read in the similar manner as in the second original document Db described earlier, and is transported to the first original document inverting means 53. The first original document Da which has passed through the first original document inverting means 53 is supported by the second support cylinder 27 as shown in FIG. 3(*f*), and passes above the second reading region 28, at which, light from the exposure lamp 48 is projected onto the first page Dal which is the other surface of the first original document Da which has not been read as yet. The light reflected by the surface of the first page Dal of the first original document Da forms an electrostatic latent image corresponding to said first page Dal on the photosensitive surface 32*a* of the photoreceptor drum 32. The first copy paper sheet Pa already completed fur copying of its one surface and accommodated in the intermediate tray 100 is fed by the feeding roller 101 so as to be transported onto the photoreceptor drum 32 through the transport passages 102 and 77. The toner image obtained by visualizing the electrostatic latent image corresponding to the first page Dal of the first original document Da and formed on the photosensitive surface 32*a* of the photoreceptor drum 32, is transferred onto the other surface not copied as yet, of the transported first copy paper sheet Pa.

The first original document Da read for the first page Dal at the second reading region 28 is transported into the transport passage 42 through the second original document inverting means 60, and thereafter, is accommodated at the lower portion of the second original document Db stored in the accommodating section 35 as shown in FIG. 3(*g*). Meanwhile, the first copy paper sheet Pa completed for copying on both surfaces is discharged onto the upper portion of the second copy paper sheet Pb stacked on the discharge tray 91 through the transport passage 90 after passing through the transport means 85.

By the functions as described so far, the duplex copying for the two original documents Da and Db is completed. Accordingly, on one surface of the first copy paper sheet Pa as obtained, the first page Dal of the first original document is copied, and on the other surface thereof, the second page Da2 of the first original document is copied. Similarly, on one surface of the second copy paper sheet Pb as obtained, the third page Db3 of the second original document is copied, while, on the other surface thereof, the fourth page Db4 of the second original document is copied.

After completion of the duplex copying, the original documents D are accommodated in said original document accommodating section 35 in a stack so that the page number thereof is successively increased from the lower portion to the upper portion in the similar manner as in the state where they were accommodated at the start of the copying. Accordingly, it is possible to effect the copying operation again, and also to take out the original documents in the similar state as they were accommodated initially. On the other hand, the copy paper sheets P are accommodated in the discharge tray 91 so that the page number thereof is successively increased from the upper portion to the lower portion.

FIG. 3(*h*) shows a state where duplex copyings of the two original documents Da and Db are again effected from the state of FIG. 3(*g*). Accordingly, the functions in FIGS. 3(*a*) to 3(*g*) are regarded to have been repeated two times, and therefore, on the display tray 91, two sets of two sheets of the copy paper sheets Pa and Pb as classified are stacked. In other words, by repeating the functions of FIGS. 3(*a*) to 3(*g*) by a plurality of times, a plurality of sets of copy paper sheets as classifed may be obtained.

In the foregoing embodiment, the original document feeder of the present invention has been mainly described with reference to the copying function for effecting the duplex copying from a both sided original document. However, the original document feeder according to the present invention is not limited in its operation to the above function alone, but may be operated for other functions, for example, one surface copying from a both sided original document, one surface copying from a one sided original document, and also, duplex copying from a one sided original document, etc. Examples of such functions will be briefly explained with reference to FIG. 2.

In the case where one surface copying is to be effected from the so-called duplex or both sided original document, i.e. where each surface of one duplex original document is to be copied onto corresponding one surface of each of two copy paper sheets, the original documents D are freely stacked on the accommodating section 35 for storing. After being fed, the document D at the uppermost portion is read for its one surface at the first reading region 25, and for its other surface at the second reading region 28, respectively. Thus, when the one surface or the other surface of the original document D has been copied onto one surface of the copy paper sheet P, said copy paper sheet P is discharged onto the discharge tray 91. Meanwhile, in the case where one surface copying is effected from the one sided original document, i.e. where copying is effected only onto one surface of the copy paper sheet from the one sided original document having information to be copied only on its one surface, the original documents D are first stacked and accommodated on the original document accommodating section 35, with each of said original documents D being directed upwards in FIG. 2 in its surface having information to be read. The original document D at the uppermost portion of the stack is read for its one surface to be read at the first reading region 25 after being fed from the original document accommodating section 35, and thereafter, passes through the second reading region 28 without being read so as to be returned to the lowermost portion of the stack of the original document D stored in the accommodating section 35. Meanwhile, when the surface of the original document D read at the first reading region 25 is copied onto one surface of the copy paper sheet P, said sheet P is discharged onto the discharge tray.

Furthermore, in the case where the duplex copying is to be effected from one sided original documents, i.e. where two sheets of one sided original documents are to be copied onto the respective surfaces of one copy paper sheet, the original documents D are accommodated in a stack on the accommodating section 35, with each of the original document D being directed upwards in its surface to be read in FIG. 2. It is to be noted here that, for the explanation, the original documents in the odd number as counted from the uppermost portion of the stack are set to be the first original documents Da, and those in the even number from the uppermost portion are set to be the second original documents Db, while for the collective description, such original documents are represented as original documents D. After being supplied, the original document D is read for its one surface to be read at the first reading region 25, while it is passed through the second reading region 28 without being read. The original document D completed for the reading function is returned to the lowermost portion of the stack of the original documents D accommodated in the accommodating section 35. Meanwhile, after having been copied, on its one surface, with the information on the surface of the first original document Da to be read, the copy paper sheet P is accommodated onto the intermediate tray 100 through the copy paper sheet inverting means 87. Thereafter, the copy paper sheet P is again fed from the intermediate tray 100 so as to be copied on its other surface, with the surface of the second original document Db read at the first reading region 25, subsequent to the first original document Da, and is further discharged onto the discharge tray 91. In the copy paper sheet P completed for the copying on both surfaces, the directions indicated by the front and reverse surfaces thereof are opposite to each other.

Figure 4:
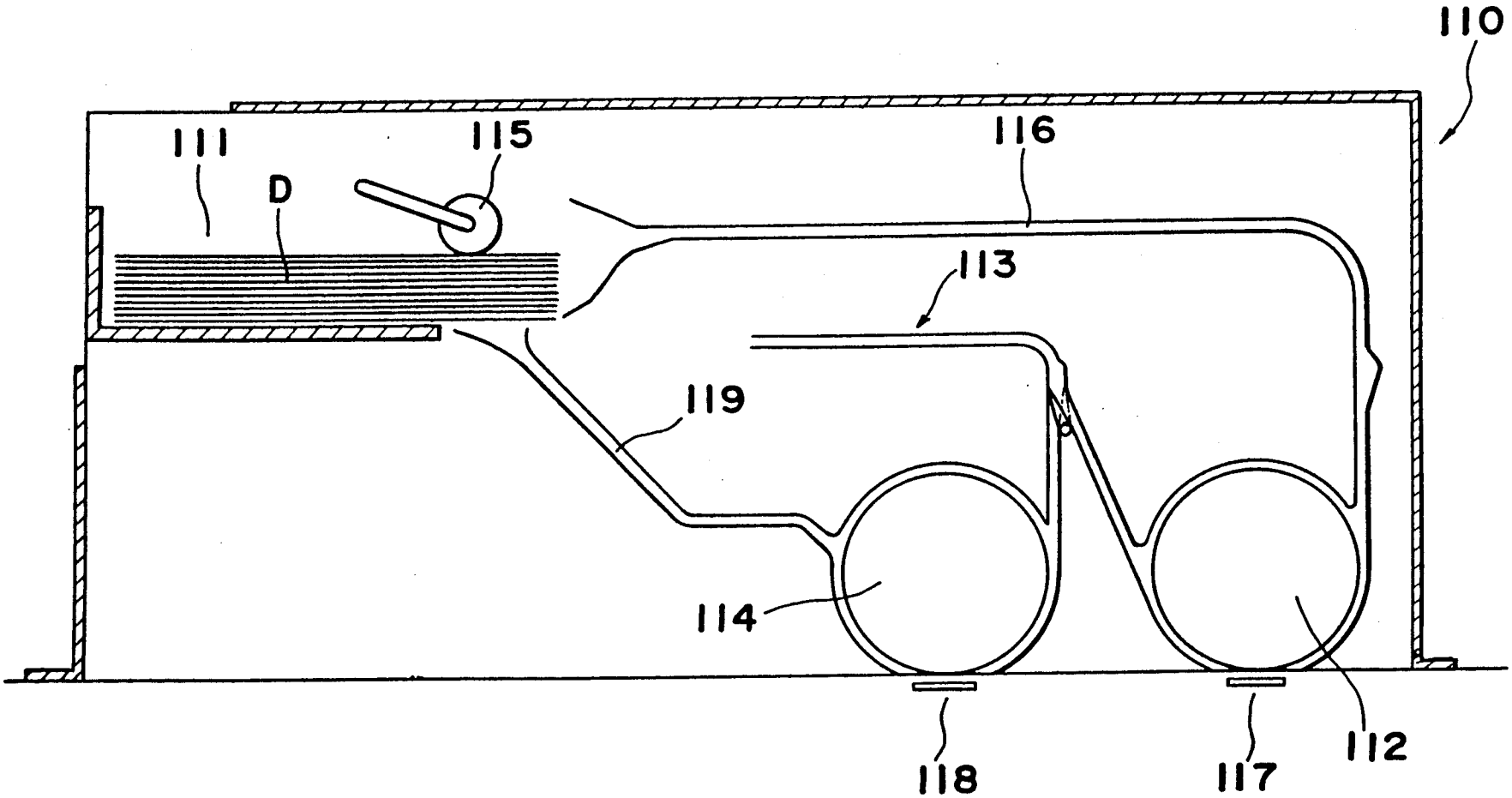
FIG. 4 is a schematic side sectional view of an original document feeder having construction resembling that of the original document feeder in FIG. 1.
Figure 5:
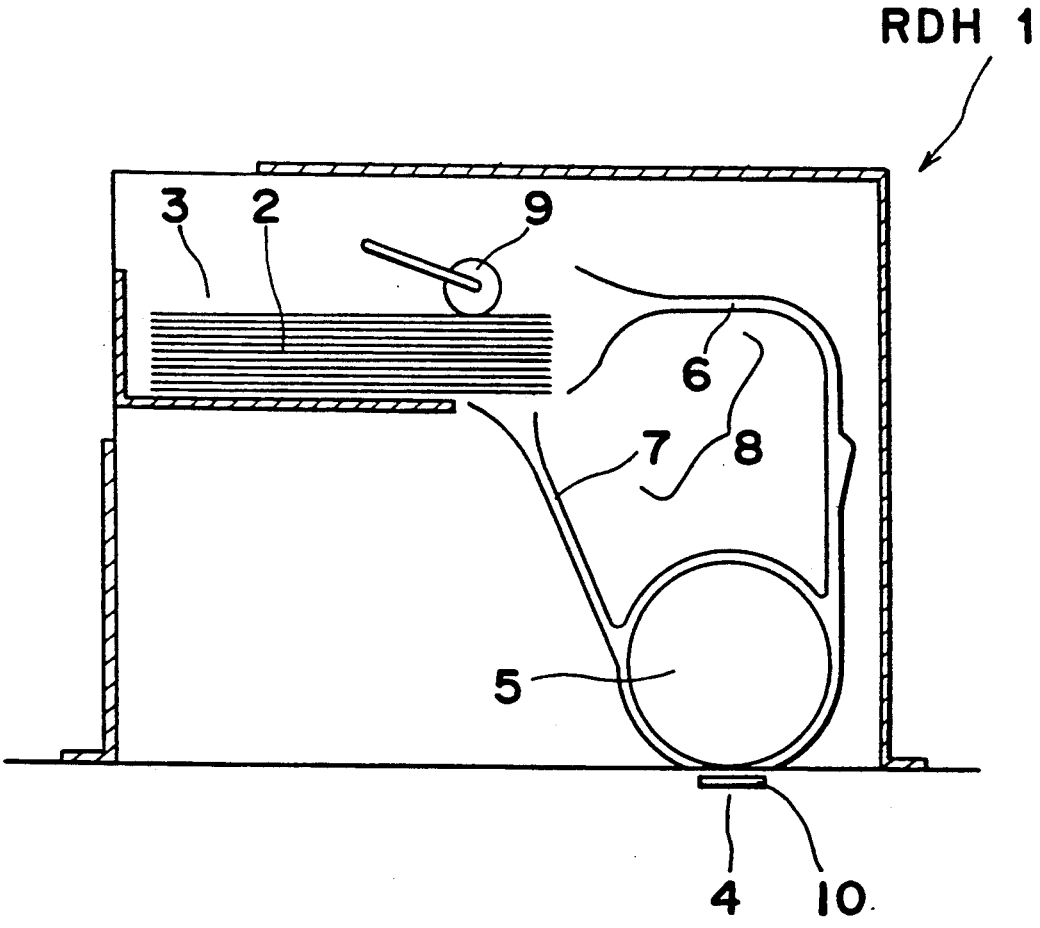
Fig. 5 PRIOR ART
FIG. 5 is a schematic side sectional view of a conventional original document feeder RDH 1 (already referred to).

FIG. 4 shows a schematic side sectional view of an original document feeder 110 having construction resembling that of the original document feeder 20 as described so far. The construction as in the original document feeder 110 may also be considered for solving the problem in the conventional arrangement that the directions indicated by the front and reverse surfaces of the original documents D accommodated in the original document accommodating section are not constant at all times during the copying operation, and are undesirably inverted.

The original document feeder 110 in FIG. 4 generally includes an original document accommodating section 111, a first support cylinder 112, an original document inverting means 113 and a second support cylinder 114 as illustrated.

When the original documents D accommodated in a stack on the original document accommodating section 111 is successively fed one sheet by one sheet from the uppermost portion by a paper feeding roller 115, it is transported onto the first support cylinder 112 through a transport passage 116. Below the first support cylinder 112, a first reading region 117 is formed, and the original document D supported by the first cylinder 112 is read for its one surface at the first reading region 117 so as to be returned to the original document inverting means 113, at which, the directions indicated by the front and reverse surfaces of the original document D are inverted, and the document D is further transported to the second support cylinder 114. Below said second support cylinder 114, there is formed a second reading region 118, where the original document D supported by the second support cylinder 114 is read for its other surface, and thereafter, is returned to the lowermost portion of the original, documents D accommodated in the stack on the accommodating section, 111 through the passage 119 from the right side in FIG. 4.

By the above arrangement of FIG. 4 also, the directions indicated by the front and reverse surfaces of the original documents D accommodated in the original document accommodating section 111 are constant at all times, and the procedure required for disposing the original document subjected, for example, to jamming, etc., back to the accommodating section 111 is simplified, with consequent improvement of the operability of the feeder as compared with the conventional feeders of this kind. However, in the above arrangement of FIG. 4, since the construction for feeding the original document D into the transport passage 116 and the construction for returning the original document D from the transport passage 119 to the accommodating section 111 are provided at the same side of the original document accommodating section 111 (i.e. at the right side thereof in FIG. 4), the conventional problem that the construction at one side is complicated around the original document accommodating section 111 is not solved. Moreover, in the arrangement of FIG. 4, it is anticipated that the size of the feeder 110 in the horizontal direction is undersirably increased.

On the contrary, according to the embodiment of FIGS. 1 to 3 of to the present invention, since the original document accommodating section 35 is installed above the original document inverting means 53 provided between the first support cylinder 24 and the second support cylinder 27, the size of the feeder in the horizontal direction may be reduced.

It is to be noted here that, in the embodiment of the present invention in FIGS. 1 to 3, the second original document inverting means 60 after the second support cylinder 27 is constituted by the third support cylinder 61 having the right circular cross section and the direction change-over claw 62. However, the second original document inverting means 60 may be modified to have a construction similar to that of the first original document inverting means 53. More specifically, in FIG. 1, by arranging to form a new passage from the end portions where the transport passage 42 and the transport passage communicated with each other, with a direction change-over claw being provided between the passages 42 and 59, the original document D transported into the passage 59 may be fed to the passage 42 through reversing of the transport direction, without changing over the directions indicated by the front and reverse surfaces of the original document D after passing through the new transport passage.

As is clear from the foregoing description, according to the original document feeder of the present invention, the directions indicated by the front and reverse surfaces of the original documents accommodated in the original document accommodating section are constant at all times during the copying, operation, and therefore, in the case where the original document is subjected to the jamming or the like during transportation through the transport passage, the directions indicated by the front and reverse surfaces of the original document subjected to the jamming and again, to be placed on the stack of the original documents of the accommodating section, may be the same as those when said original document was initially accommodated in said accommodating section, and thus, there is no possibility that the undesired surface is copied, with a consequent improvement of the operability of the feeder. Furthermore, according to the embodiment of the present invention, the constructions for the feeding of the original documents and for the accommodation thereof are not deviated at one side of the original document accommodating section, but are provided at the opposite sides of said accommodating section, and therefore, the portion around the accommodating section is not complicated.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An original document feeder which comprises:

an original document accommodating section arranged to feed in original document from a stack of sheet-formed original documents from a first end side at the uppermost portion of said stack and to return said original document to a second end side at the lowermost portion of said stack, a first original document presenting section for supporting said original document during reading of a first surface of said original document fed from said original document accommodating section, a second original document presenting section for supporting said original document during reading of a second surface of said original document, a first original document inverting means provided between said first original document presenting section and said second original presenting section for inverting said first and said second surfaces of said original document, and a second original document reversing means for reversing transporting direction of said original document without inverting said first and said second surfaces of said original document after being supported by said second original document presenting section.

2. The original document feeder as claimed in claim 1 which further comprises a transport roller means for transporting said original document between said first original document presenting section and said first original document inverting means and between said first original document switchback inverting means and said second original document presenting section.

3. The original document feeder as claimed in claim 1, wherein said first original document presenting section includes a first rotatable support cylinder and a first reading region, said first reading region being provided below said first support cylinder, wherein said second original document presenting section includes a second rotatable support cylinder and a second reading region, said second reading region being provided below said second support cylinder, said first support cylinder and said second support cylinder being disposed side by side, said first support cylinder being rotated to wind said original document fed thereto for presentation at said first original document presenting section, said transport roller means being rotated to transport said original document fed thereto along a path to said second support cylinder and said second support cylinder being rotated to wind said original document fed thereto for presentation at said second original document presenting section.

* * * * *